US006146264A

United States Patent [19]

Tong et al.

[11] Patent Number: 6,146,264

[45] Date of Patent: Nov. 14, 2000

[54] PAINT BOOTH AIRFLOW CONTROL SYSTEM

[75] Inventors: Ernest Henry Tong, Canton; Dimitre Filev, Novi, both of Mich.

[73] Assignee: Ford Global Technologies, Inc., Dearborn, Mich.

[21] Appl. No.: 09/149,745

[22] Filed: Sep. 8, 1998

[51] Int. Cl.[7] ..... B05C 15/12

[52] U.S. Cl. ..... 454/52

[58] Field of Search ..... 454/51, 52, 53, 454/54; 118/326

[56] References Cited

U.S. PATENT DOCUMENTS

| | | | |
|---|---|---|---|
| 4,729,295 | 3/1988 | Osawa et al. | 454/52 |
| 4,730,553 | 3/1988 | Osawa et al. | 454/52 |
| 4,840,116 | 6/1989 | Murakami et al. | 454/52 |
| 5,356,335 | 10/1994 | Matsui et al. | 454/52 |

FOREIGN PATENT DOCUMENTS

| | | |
|---|---|---|
| 0480664 A2 | 10/1991 | European Pat. Off. . |
| 2007883 | 5/1979 | United Kingdom . |

OTHER PUBLICATIONS

Single page titled "Features of the ABB Flakt Spraybooth Balance System".

*Primary Examiner*—Harold Joyce
*Attorney, Agent, or Firm*—Damian Porcari

[57] ABSTRACT

An automotive paint booth containing multiple contiguous chambers can be supplied with down flowing air streams in the various chambers for removing airborne particulates produced by the painting operations. Cross flow of particulates between contiguous chambers can be controlled by slightly varying the down flow velocities in the respective chambers.

4 Claims, 4 Drawing Sheets

PAINT BOOTH AIRFLOW CONTROL SYSTEM

BACKGROUND AND SUMMARY OF THE INVENTION

This invention relates to an automotive body paint booth, and particularly to an air flow control system for such a paint booth.

Typically automotive bodies are painted in the factory by placing each automotive body on a conveyor, and moving the conveyor through an elongated booth, or tunnel, containing multiple contiguous chambers. In each chamber a specific operation is performed on an automotive body as it passes through the respective chamber.

In some chambers mechanical robot painting mechanisms apply paint colorant or clear coat to specific areas of the automotive body, using electrostatic coating techniques. In other chambers, paint colorant or clear coat is applied mechanically to the automotive body, using compressed air spraying techniques. In some chambers a human technician is employed to spray paint colorant or clear coat to areas of the automotive body that cannot be adequately covered by the use of mechanical coating sprayers. The paint spray booth includes at least one flash-off chamber designed to remove volatile paint solvents that give the paint colorant or clear coat flowability; removal of such volatiles prevents different colorants from running or mixing together on the automotive body.

In many of the spray booth chambers excess paint mists or airborne particulates are generated as a result of the coating processes performed in the respective chambers. To remove such mists and airborne particulates it is a common practice to provide a down flow air system in the affected chambers. Air flows downwardly through a perforated ceiling, into the chamber, and through a perforated floor into a sub-chamber containing a mist eliminator mechanism. The down flowing air continually removes airborne particulates in the chamber that could adversely affect the quality of the coating operation or pose a health risk to the human technician in the chamber.

One problem associated with the down flowing air is that any unbalance in the down flow air velocity in contiguous chambers can produce an undesired horizontal cross flow from one chamber to an adjacent chamber. Air tends to migrate horizontally from a chamber having a relatively high velocity down flow into a contiguous chamber having a lower velocity down flow. If such cross flows are left uncontrolled the associated particulate migrations can adversely affect the coating process or produce uncomfortable conditions for the human technicians. For example, the introduction of paint particles of one color into a chamber used for applying a different colorant to the automotive body can adversely affect product quality.

The present invention is concerned with an airflow control system, wherein horizontal cross flows between contiguous chambers in the paint spray booth are controlled so as to prevent undesired product quality problems or adverse conditions for the human technicians in selected chambers. The airflow control system includes sensors for measuring the down flow velocity in each affected chamber, and also the cross flow velocity between contiguous chambers. Signals generated by the velocity measurement sensors are applied to control motors used on air supply fans and dampers that determine the down flow velocity values in the contiguous chambers.

In the present invention, the cross flows between contiguous chambers are controlled by adjusting the down flow velocities in the contiguous chambers. An airflow control algorithm, containing target values for down flow and cross flow, provide a base against which the sensed velocity values are compared, so as to provide a desired air flow balance.

Specific features of the invention will be apparent from the attached drawing and description of an illustrative embodiment of the invention.

DESCRIPTION OF A PREFERRED EMBODIMENT OF THE INVENTION

Figure 1:
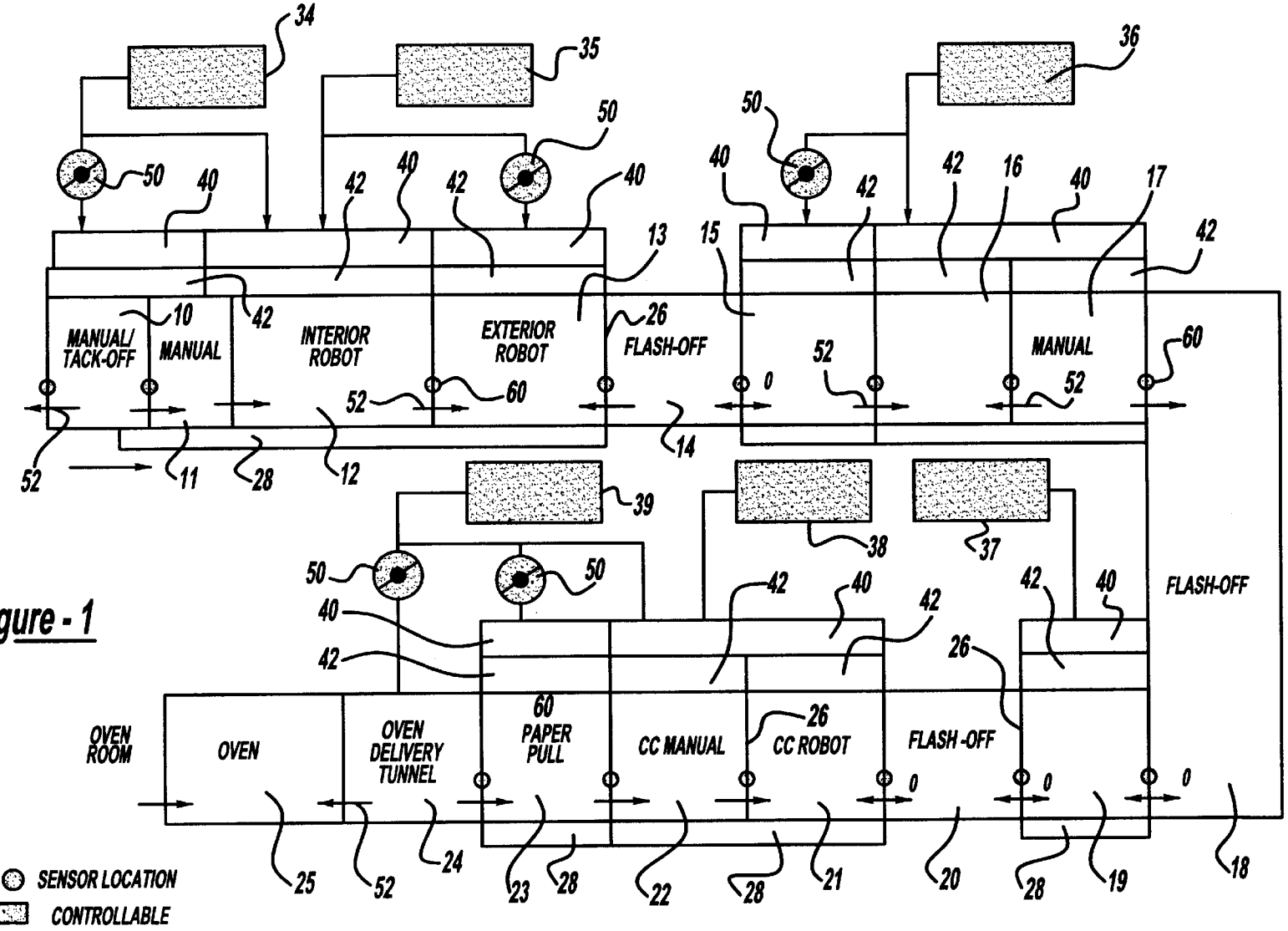
FIG. 1 is a schematic representation of an automotive paint booth having an airflow control system of the present invention.

Referring to FIG. 1, there is schematically shown an automotive paint booth that can utilize the present invention. The booth is an elongated tunnel structure subdivided into multiple contiguous chambers referenced by numerals 10 through 25. These contiguous chambers are separated by vertical partitions, one of which is shown at 26 in FIG. 5. Each partition has a relatively large opening 27 therein adapted to permit an automotive body 28 to pass there through, i.e., from one chamber to the next contiguous chamber.

The automotive bodies are supported on a floor conveyor for continuous movement through the various chambers 10 through 25 in sequential fashion. In each chamber a different operation is performed on the automotive body that is momentarily in the respective chamber.

The automotive bodies progress through the various chambers, beginning in chamber 10 and ending in chamber 25.

In chamber 10 human technicians inspect the incoming automotive body, and remove any surface dirt that might interfere with the painting operations. In chambers 11, 17 and 22 human technicians operate compressed air spray guns for applying paint colorant or clear coat to selected areas of the automotive body. The term "CC" in FIG. 1 means clear coat.

In chambers 12, 13 and 21 robotic painting mechanisms apply paint colorant or clear coat to the automotive body, using electrostatic coating techniques. Chambers 14, 18 and 20 are vacant chambers that are used to remove volatile solvents from the automotive body, whereby the previously applied coatings are in a stabilized semi-dried condition that prevents the coatings from flowing or mixing with other coatings that are to be applied in subsequent chambers. These so-called "flash-off" chambers may be heated or unheated. Chambers 15, 16 and 19 contain mechanical (automatic) paint sprayers that use compressed air to spray selected areas of the automotive body with paint colorant or clear coat.

During the coating operations excess particles of paint colorant or clear coat accumulate in the respective chambers. Such airborne particulates are removed from the respective chambers in order to prevent any contamination of the automotive body surface, and also to maintain a particle free environment in those chambers occupied by human technicians, i.e., chambers 10, 11, 17, 22 and 23. Airborne particulates are removed from the respective chambers by flowing air downwardly through each chamber. The down flowing air entrains any particulates in the chamber for later disposal in sub-chambers 28. Each sub-chamber contains a mist eliminator mechanism of the type shown at 30, 31 in FIG. 2. Each sub-chamber 28 is connected to a suitable exhaust blower 32 that exhausts the particle-free air to the external (outdoor) atmosphere.

Down flowing particle-removal air is supplied to selected ones of the treatment chambers by means of overhead fans (blowers) 34 through 39. The illustrated system uses six air supply fans, but different numbers of fans can be used, depending on the nature and complexity of the paint booth. Each fan 34 through 39 has a volumetric output that can be varied by a suitable electrical control signal. Typically the fan motor speed will be varied by a variable frequency drive that can include a silicon controlled rectifier connected to a variable value control trigger circuit.

In an alternate arrangement the volumetric output of the fan can be varied by a system of radial louvers in the fan inlet controlled by a variable speed servo motor responsive to a control signal of variable magnitude.

Each fan 34 through 39 supplies pressurized air to a plenum 40 associated with one or more of the treatment chambers 10 through 24. Each plenum 40 feeds pressurized air to a chamber 42 containing an array of bag filters 43 (FIG. 2), whereby the air supplied to treating chambers 10 through 13, 15 through 17, 19, and 21 through 23, is particle-free. Each chamber 42 can be equipped with panel-type filters 44 to collect any particulates that might pass through the bag filters.

Figure 5:
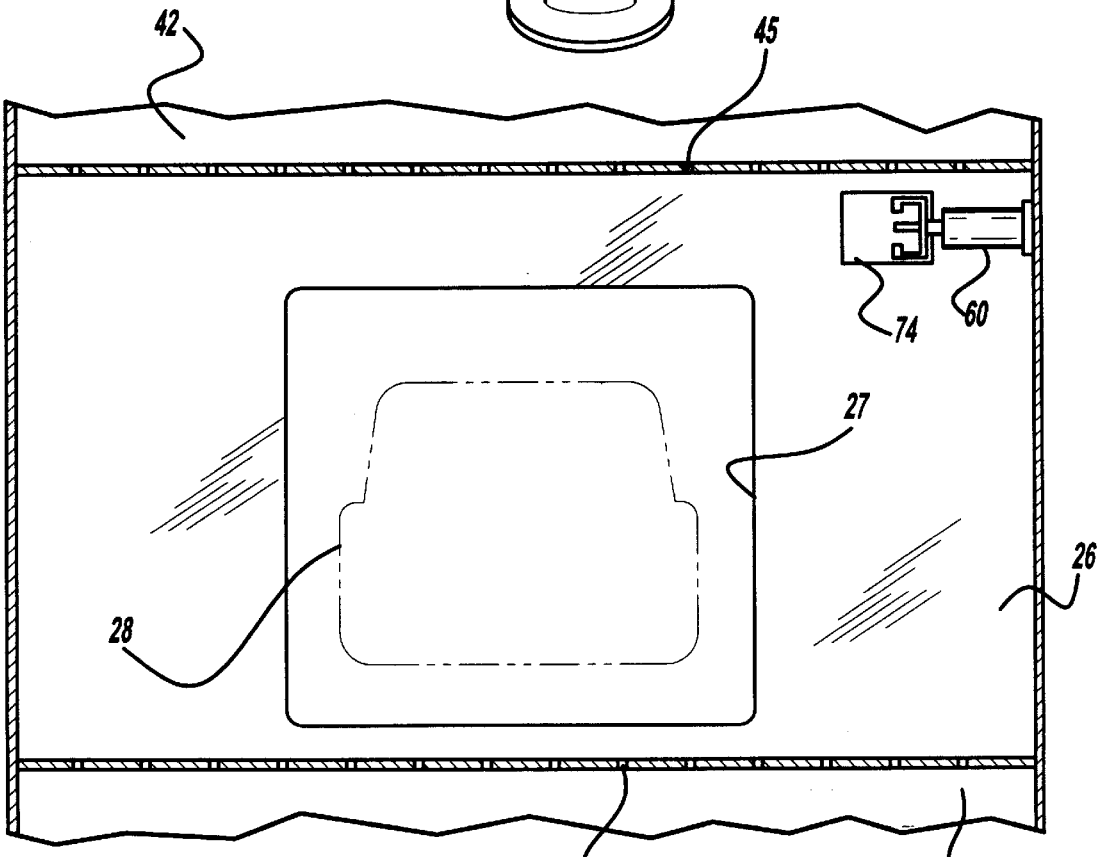
FIG. 5 is a fragmentary view taken in the same direction as FIG. 2, but showing features not apparent in FIG. 2.

The ceiling for each treating chamber is perforated, as indicated at 45 in FIG. 5, whereby the down flowing air is distributed essentially uniformly across the ceiling surface. The down flowing air, with entrained particulates, is exhausted from each treating chamber through a perforated floor 46 (FIG. 5) that communicates with an associated sub-chamber 28. As previously noted, each sub-chamber 28 contains a mist-eliminator mechanism 32.

Figure 2:
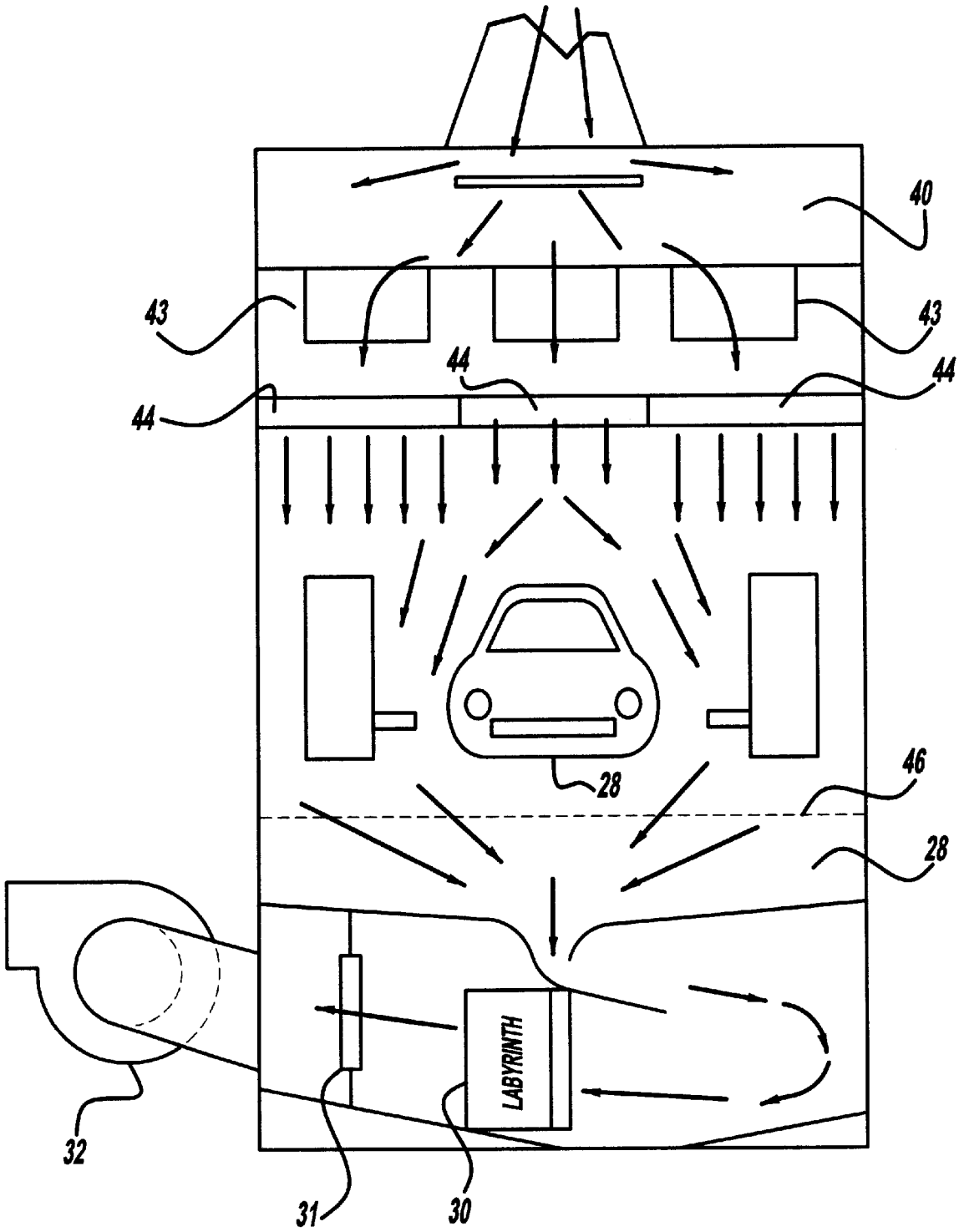
FIG. 2 is a transverse sectional view taken through an illustrative treatment chamber in the FIG. 1 paint booth.

It will be seen that each treating chamber 10 through 13, 15 through 17, 19, and 21 through 23, is supplied with pressurized air via a plenum 40. The down flowing air is exhausted out of each treating chamber through a sub-chamber 28. Each sub-chamber 28 is connected to an exhaust fan 32 (FIG. 2). Each air supply fan 34 through 39 is individually controlled to vary the velocity of the down flowing air in treating chambers 10 through 13, 15 through 17, 19 and 21 through 23.

Each fan 34, 35, 36 and 39 supplies pressurized air to two or more plenum chambers 40. The individual flows to the respective plenum chambers 40 are apportioned by motorized dampers 50. The illustrated system uses five motorized dampers.

Each motorized damper 50 can include an array of parallel or angulated butterfly dampers spanning the flow duct to move between open positions permitting full flow through the duct and closed positions completely closing the flow duct. The butterfly dampers are moved synchronously between the open and closed positions by a servo motor connected to the dampers by a suitable parallel bar linkage.

In the illustrated system each fan 34, 35, 36 or 39 is connected to two plenum chambers 40 by a branched passage system that includes one branch passage containing a damper and another non-dampered branch passage. The dampered branch passage preferably has a slightly greater flow capacity than the non-dampered branch passage, so that operation of the damper can produce a dampered flow that is slightly less or slightly greater than the non-dampered flow.

It will be seen that when a damper is moved in the closing direction to restrict flow through the associated flow duct, the flow through the companion duct is necessarily increased. Each motorized damper 50 thus apportions the flow between two (or more) treating chambers. For example, when damper 50 associated with treating chamber 15 is moved in the closing direction the flow to treating chambers 16 and 17 is necessarily increased. Conversely, when damper 50 for chamber 15 is moved in the opening direction the down flow air into treating chamber 15 is increased while the down flow air into chambers 16 and 17 is decreased.

The various treating chambers 10 through 25 are separated by vertical partitions, as shown at 26 in FIG. 5. However, each partition has a relatively large opening 27 sized to permit an automotive vehicle body to pass from one chamber to the next contiguous chamber. Each treating chamber is pressurized slightly by the down flowing air that is used to remove airborne contaminants (particulates). If the pressure in one chamber should momentarily be higher than the pressure in a contiguous chamber, some of the air in the more highly pressurized chamber will flow horizontally from the highly pressurized chamber into the less pressurized chamber. In some circumstances such horizontal cross flow can be detrimental to system performance.

For example, cross flow from robotic chamber 12 into manual chamber 11 can be detrimental because of the breathing problems associated with inhaling paint colorant particulates. Similarly, cross flow from chamber 16 into manual chamber 17 can be detrimental. Likewise, cross flow from robotic coating chamber 42 into manual chamber 22 can be detrimental.

For a different reason, cross flow between different ones of the automatic painting chambers can be detrimental to system performance. A primary concern is that paint colorant of one color not be circulated into another chamber where a colorant coating of a different color is being applied to a vehicle body.

In FIG. 1, arrows 52, are applied to the partitions between contiguous treating chambers, indicating the desired (target) direction of cross flowing air between contiguous chambers. In certain chambers it is desired to eliminate cross flow entirely, as designated by the double arrows applied to the partitions associated with flash-off chambers 14, 20 and 18.

The present invention is concerned primarily with controlling cross flows across the various chamber partitions 26, whereby system performance is enhanced while preserving the health and comfort of human technicians located in treating chambers 10, 11, 17, 22, 23 and 24.

Cross flow between contiguous chambers is influenced or caused by pressure imbalances between the chambers. Such imbalances can be influenced by the relative difference in the amount of air supplied to a given chamber and the amount of air exhausted from that chamber. If the amount of air supplied is greater than the amount exhausted, that chamber could be positively pressurized compared to the adjacent chambers. The present invention contemplates an airflow control system that determines the directions of pressure imbalance and crossflow, as denoted by arrows 52 in FIG. 1. By controlling the downflow velocities in contiguous treating chambers it is possible to control the direction and magnitude of the cross flow. Target downflow velocities will be slightly different in contiguous chambers to control the direction of crossflow.

Figure 4:
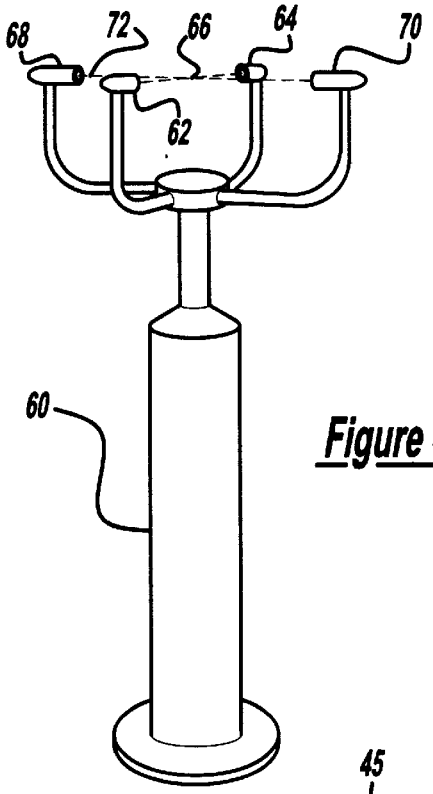
FIG. 4 shows an air velocity measuring system used in the FIG. 1 airflow control system.

The velocity of the downflowing air in any given treatment chamber is varied or controlled by the associated air supply fan alone, or by the fan in combination with the associated motorized damper 50. The fans and dampers are controlled by flow velocity sensors 60 located at the partitions 26. In FIG. 1 each sensor assembly is designated by a circle 60 at one of the partitions 26. The illustrated systems uses fifteen flow sensor assemblies. FIG. 4 shows one of the flow sensor assemblies that can be used. FIG. 5 shows one way in which the flow sensor assembly can be mounted and oriented.

Flow measurement sensor assembly 60 is a two axis anemometer designed to measure air velocity in two orthogonal directions. The sensor assembly is mounted and oriented to measure flow velocity in the vertical (downflow) direction and in the horizontal (cross flow) direction. The preferred flow measurement anemometer is a two axis ultrasonic meteorological anemometer commercially available from Gill Instruments Ltd. at Solent House, Cannon St. Lymington, Hampshire, S041 9BR, England. The preferred flow measurement anemometer produces useful variable voltage signals at relatively low air velocities from zero to twenty feet per minute, which is the air velocity range of interest for use in the present invention.

The preferred two axis anemometer includes a first acoustic pulse emitter 62 and acoustic pulse receiver 64 oriented to generate an ultrasonic beam 66. The anemometer further includes a second acoustic pulse emitter 68 and acoustic pulse receiver 70 oriented to generate a second ultrasonic beam 72 that has an orthogonal relationship to beam 66.

The anemometer is mounted on or near a partition 26 so that the emitter-receiver combinations 62, 64 and 68, 70 are in registry with a small pilot opening 74 in partition 26. Pilot opening 74 will typically be a relatively small square opening measuring about twelve inch along each edge, whereby pressure differentials on opposite faces of the partition will produce a horizontal cross flow through opening 74 that is representative of the horizontal cross flow through the larger opening 27.

As shown in FIG. 5, anemometer 60 is mounted so that one of the emitter-receiver combinations measures horizontal cross flow through pilot opening 74 while the other emitter-receiver combination measures the vertical down flow from perforated ceiling 45 to perforated floor 46. The ultrasonic beams generated by the emitter-receiver combinations have varying travel times related to the velocity of the air stream in which the beam is located. By measuring the beam travel time it is possible to measure the air velocity. The commercially available anemometer marketed by Gill Instruments Ltd. can be used in the paint booth environment for generating electrical signals suitable for controlling the air supply fans and dampers.

Each two axis anemometer 60 is preferably located above and to one side of the large opening 27 so as not to interfere with the coating operations. Any particulates deflected from the anemometer are not likely to impact the automotive body. The elevated location of the anemometer near perforated ceiling 45 is an area where there is not likely to be any appreciable number of particulates (e.g., paint colorant particles).

The two axis anemometer is advantageous in the paint booth environment because it is robust and has no moving parts that could be contaminated by the environment. Also, the electronics are sealed within the cylindrical casing so that there is no danger of explosion due to sparking in the presence of volatile vapors. Intrinsic safety is primarily provided by the casing construction and sealing gaskets, and by the use of special low voltages used in the electronics. Each anemometer is relatively compact, while being capable of simultaneously measuring air flows in two orthogonal directions, i.e., down flow through the chamber and cross flow between two contiguous chambers.

The electrical signals generated by the various anemometers are suitably applied to the air supply fan motors and damper motors to maintain the desired down flow velocity and cross flow velocity, as indicated by arrows 52 in FIG. 1. As noted, the anemometers read actual crossflows and downflows. However the number of variables is so great that the control functions have to be carried out with a computer, using an algorithm that takes account of the effect of fan speed changes and damper motor position changes on conditions throughout the system. For example, a change in one treatment chamber can exert a domino effect on many other chambers in the system (not merely the contiguous chambers). The control system includes anemometer target values for the crossflow signals and downflow signals. When the system makes a change to either a fan speed or damper position, the system keeps track of how much each anemometer reading changes as a result of the fan speed change or damper position change. There is a collection of the response sensitivities, which we call the Jacobian, i.e. the anemometer change resulting from change in fan speed or damper position. The system uses algorithms to determine the best set of fan speeds and damper positions that will make the anemometer readings as close to the target values as possible. The system tracks the error and tries to drive the error to zero, using an iterative process that is continually repeated. Since the dampers affect the overall resistance of each passage system, it will sometimes be necessary to change the fan motor speed along with changes in damper position, in order to maintain a desired down flow velocity. For example, when damper 50 is moved in the closing (throttling) direction, the resultant increase in air flow resistance at the fan outlet requires some increase in the fan speed to maintain the target down flow velocity in each branch passage.

Figure 3:
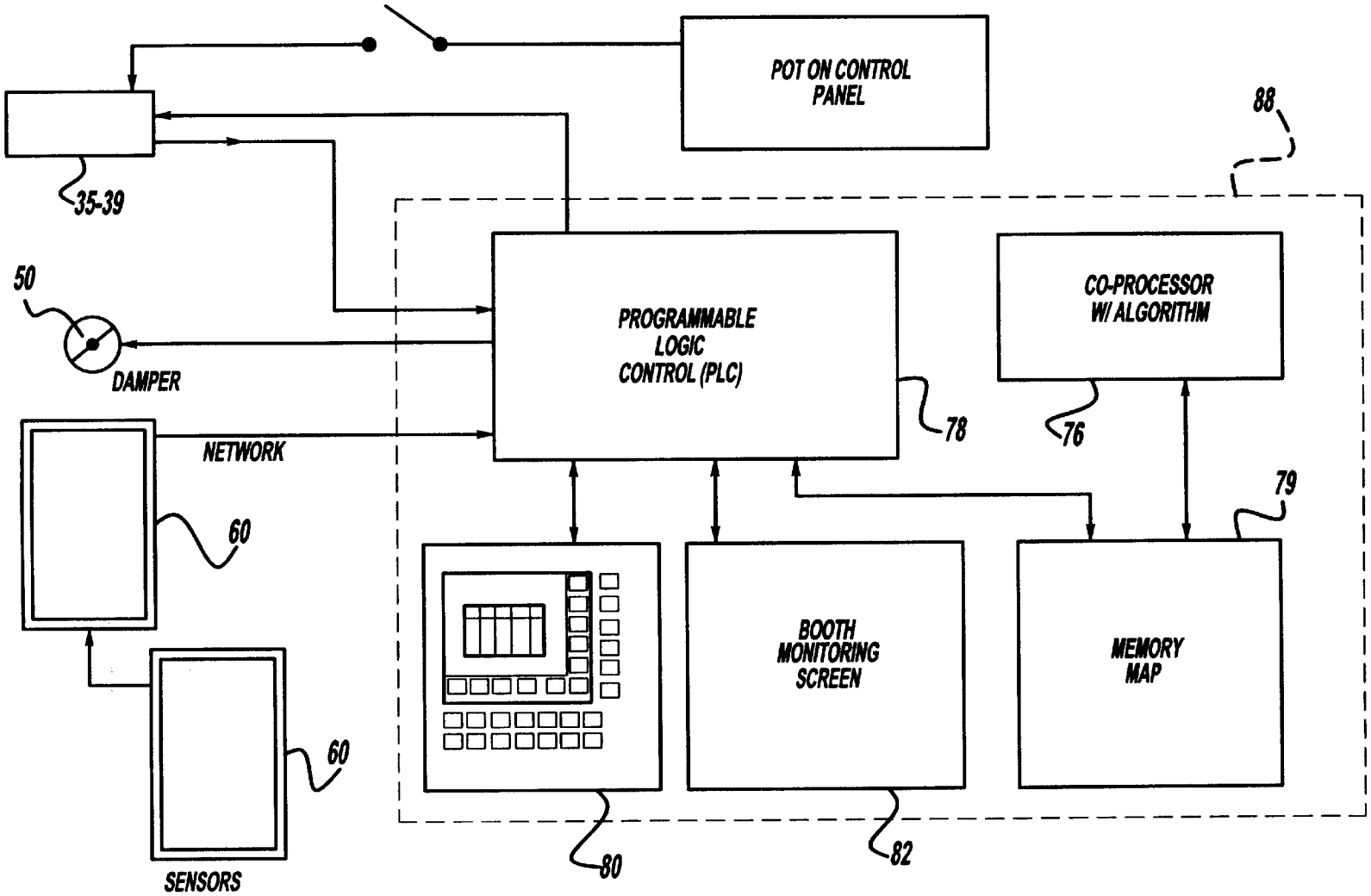
FIG. 3 is a schematic representation of a circuit for controlling the airflow control system of FIG. 1.

As noted, the complexity of the airflow control system requires that the control activities be carried out by a suitable computer (or microprocessor) containing an air flow control algorithm capable of carrying out multiple control actions essentially simultaneously. FIG. 3 shows in schematic fashion one particular computer arrangement that can be used.

The anemometers used in preferred practice of the invention use ultrasonics to measure air flow velocities. The automotive body paint booth can, at various times, be noisy so as to possibly mask anemometer malfunctions. Therefore, in preferred practice of the invention a diagnostic capability is included for uncovering anemometer malfunctions. In one scenario an anemometer malfunction is sensed when a given anemometer outputs exactly the same output signal a given times in a row, or when the output signal exceeds some very large number.

The diagnostic sub-system keeps track each time an anemometer violates the criteria for anemometer malfunctions. The probability of anemometer failure is calculated, based on the failure history for the particular instrument. This is necessary because the environment is very noisy. Stray signals may falsely suggest sensor (anemometer) failure. Using the probability of sensor failure as a control feature, it is possible to alleviate false malfunction warnings associated with the noisy environment.

In FIG. 3, the aforementioned computer is designated generally by numeral 88. The computer comprises a co-processor 76 containing an algorithm that is designed to drive the fans and dampers toward the desired operating mode represented by arrows 52 in FIG. 1. The computer further comprises a programmable logic control 78, memory map 79, monitoring screen 82, and keyboard 80. The programmable logic control receives signals from sensors 60 and delivers control signals to the fan motors and damper motors. Logic control 78 can be controlled by co-processor 76 or keyboard 80.

The co-processor provides computational power that is lacking in the programmable logical control 78. The PLC 78 and co-processor share data in the memory map 79, such that the PLC can be operated independently of the co-processor if manual (keyboard) control is desired. Such manual control is a desirable option should the automatic system fail to provide the desired airflow balance, e.g. during a fan failure.

The monitoring screen 82 displays information on current status of the system, including any perceived sensor 60 failures. Sensor replacement is accomplished when the system is in a down condition.

The FIG. 3 system can operate in four different modes, i.e. automatically by co-processor 76, manually via keyboard 80, jointly such that co-processor 76 makes recommended decisions that the human operator can override, or semi-manually wherein control is switched from time-to-time between manual control and automatic control.

A principal aim of the invention is to provide an airflow control system wherein cross flow between contiguous chambers is controlled as to direction and magnitude within reasonable limits. The control action is more precise and predictable when a computer having an operating algorithm is used to determine the corrective signals applied to the fan motors and damper motors.

What is claimed:

1. An automotive body paint booth comprising multiple connected contiguous treatment chambers adapted to have automotive bodies pass sequentially there through in repetitive fashion; means for moving air downwardly through selected ones of said chambers for removing contaminants from said chambers; and means for controlling cross flow of air between said chambers; said cross flow control means comprising means for measuring the cross flow between adjacent chambers and means for measuring the down flow within individual chambers.

2. The paint booth of claim 1, wherein said contiguous chambers are separated by vertical partitions; each said vertical partition having a relatively large opening adapted to pass an automotive body and a relatively small pilot opening adapted to pass air between contiguous chambers; said cross flow control means comprising a two axis ultrasonic anemometer located at each said partition proximate to the associated pilot opening; each anemometer having a first emitter-receiver combination oriented to measure cross flow through the respective pilot opening, and a second emitter-receiver combination oriented to measure down flow along the associated partition.

3. An automotive body paint booth comprising multiple connected contiguous treatment chambers adapted to have automotive bodies pass sequentially there through in repetitive fashion; means for moving air downwardly through selected ones of said chambers for removing contaminants from said chambers; and means for controlling cross flow of air between said chambers; said cross flow control means comprising a two axis ultrasonic anemometer having a first emitter-receiver combination oriented to measure cross flow between adjacent chambers, and a second emitter-receiver combination oriented to measure down flow within an individual chamber.

4. An automotive body paint booth comprising multiple connected contiguous treatment chambers adapted to have automotive bodies pass sequentially there through in repetitive fashion; means for moving air downwardly through selected ones of said chambers for removing contaminants from said chambers; and means for controlling cross flow of air between said chambers; said cross flow control means comprising multiple anemometers located between contiguous chambers; each anemometer comprising an ultrasonic anemometer having a first emitter-receiver combination oriented to measure cross flow between contiguous chambers, and a second emitter-receiver combination oriented to measure down flow within an individual chamber.

* * * * *